US006103326A

United States Patent [19]

Kobayashi

[11] Patent Number: 6,103,326

[45] Date of Patent: Aug. 15, 2000

[54] MULTIPLE LAYERED CARDS AND METHOD OF PRODUCING SAME

[75] Inventor: Junichi Kobayashi, Tokyo, Japan

[73] Assignee: Bertek Systems, Inc., Cincinnati, Ohio

[21] Appl. No.: 09/027,801

[22] Filed: Feb. 23, 1998

Related U.S. Application Data

[63] Continuation-in-part of application No. 08/701,790, Aug. 26, 1996, abandoned.

[51] Int. Cl.[7] ..... G09F 3/00

[52] U.S. Cl. ..... 428/40.1; 283/81; 283/94; 283/98; 283/101; 283/901; 428/40.5; 428/41.4; 428/41.9; 428/42.1; 428/42.2; 428/42.3; 428/43; 428/192; 428/201; 428/202

[58] Field of Search ..... 428/40.1, 40.5, 428/41.4, 41.9, 42.1, 42.2, 42.3, 43, 192, 201, 202; 283/81, 94, 98, 101, 901

[56] References Cited

U.S. PATENT DOCUMENTS 4,664,416 5/1987 Steidinger ..... 283/81
5,284,689 2/1994 Laurash ..... 428/40.1

*Primary Examiner*—Nasser Ahmad
*Attorney, Agent, or Firm*—Thomas N. Neiman

[57] ABSTRACT

The present invention is directed to a card structure which is a multiple layered card which expands the areas that can be used to provide printed information and protects that information while maintaining a designated finished card size. The primary or top sheet has a front side having an area onto which is printable. The back side of the sheet also can be printed upon and has a coated layer of adhesive and or a release agent as desired. The information printed can be static or variable or a combination thereof for each finished card. The secondary or bottom sheet also has a front and rear side that have printable areas located thereon and a layer of adhesive and of release agent can be coated as necessary on the front of the secondary sheet depending upon the nature of the coating on the back of the primary or top sheet. A small slit can be made in the top or bottom sheet to allow the user to more easily separate the multiple layered card the card. In use, the consumer will grasp the multiple layered card and bend it at the small slit or at an overlapped edge which will facilitate the separation of the card into two separate cards. A method of producing the multiple layered cards is also disclosed.

4 Claims, 3 Drawing Sheets

MULTIPLE LAYERED CARDS AND METHOD OF PRODUCING SAME

This is a continuation in part application of application Ser. No. 08/701,790, filed on Aug. 26, 1996 which is now abandoned.

BACKGROUND OF THE INVENTION

This invention pertains to card type devices, and in particular, to such multiple layered cards that are designed to allow the user to easily separate the multiple sheets of the card to reveal additional information such as a contents, instructions and personalized information or the like that are printed on the sides of the card that have been laminated together. A method of producing the multiple layered cards is also disclosed.

Many types and designs of advertisements and cards are currently on the market. Most current advertising mechanisms allow for a single ply or double ply information panel. The current type card unit construction comprises single ply cards that are printed on their front and rear sides; double post cards that have a plurality of printable panels, but do not conceal the information; and single ply cards that use a scratch off concealing method. What is needed is a multiple layered card that will provide many sheets of information that can hide valuable information to be revealed and maintain this information within the same finished size as a single or double sided panel.

What has not been done in this area is a single piece item that can be in the form of a postcard or handout that can contain important information like a personalized numbers, telephone card pin numbers or discount coupons or recipe information on the sealed portion of the multiple sheets of material that have been laminated together and, at the same time, can easily be separated from each other to reveal that information. What is needed is multiple layered cards that an individual can easily and effectively print on current printing equipment while, at the same time, maintaining a designated finished card size. What is also needed is an item which will allow an infinite variety of options in terms of the material being printed upon any of the sides of the multiple sheets of the item, in other words, double the information area and, at the same time, conceal the internal static and or variably printed information.

Clearly, it is desirable for a item of this type to be very adaptable. At the same time, the item should be easy to manufacture and be produced of cost effective material. It is the object of this invention to set forth multiple layered cards which avoid the disadvantages, previously mentioned limitations of typical current card vehicles.

SUMMARY OF THE INVENTION

Particularly, it is the object of this invention to teach multiple layered cards, for situations that require the use of an item that can be peeled apart and reveal additional information to the user, comprising multiple sheets of material, at least one of said sheets of material comprising a card unit; said multiple sheets of material having a primary sheet of material containing a front side and a rear side, said front side and said rear side having a plurality of printable areas for printing of information selected from a group of contents, instructions, or personalized information; said multiple sheets of information further having a secondary sheet of material containing a front side and rear side, the front side and the rear side having a plurality of printable areas for printing of information selected from a group of contents, instructions, personalized information; release agent means positioned in predetermined areas on one of said sheets of material; attaching means positioned in predetermined areas on one of said sheets of material; said primary sheet and said secondary sheet comprising a single entity by being laminated together transferring said attaching means to said opposite sheet; at least one of said sheets having a separation mechanism positioned thereon; and said separation mechanism comprising a cut that must be made at least on said sheet of material comprising said card unit.

It is also the object of this invention to teach a method of producing multiple layered cards, for situations that require the use of an item that can be peeled apart and reveal additional information to the user, comprising the steps of providing sheets of material, each of said sheets of material having a front side and a rear side, at least one of said sheets of material comprising a card unit; printing said sheets of material on any of the sides as desired for the purposes of the specific item; applying a coating of release agent on one of said sheets of material in a predetermined fashion in order to facilitate separation of the sheets of materials when desired; applying an adhesive layer on one of said sheets of material over the coating of release agent in order to facilitate the joining of the sheets of material together; laminating of the sheets together transferring the adhesive layer into the position desired; installing a separation mechanism on one of said sheets to increase the ease of separation of said sheets; and said separation mechanism comprising a cut that necessarily must be made on at least said sheet of material comprising said card unit.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
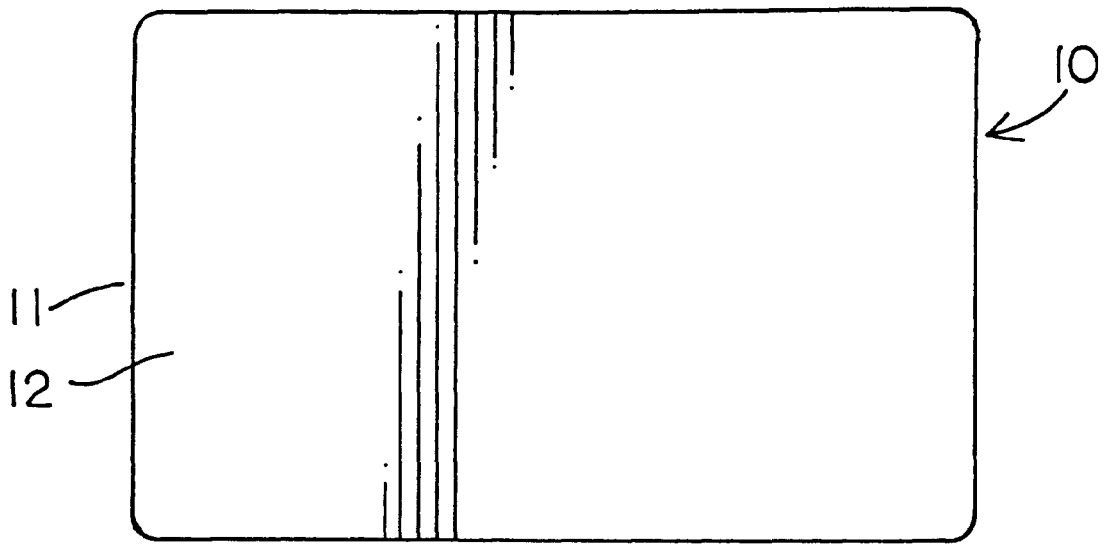
FIG. 1 is a front elevational view of the front side of the primary sheet of the multiple layered cards.
Figure 2:
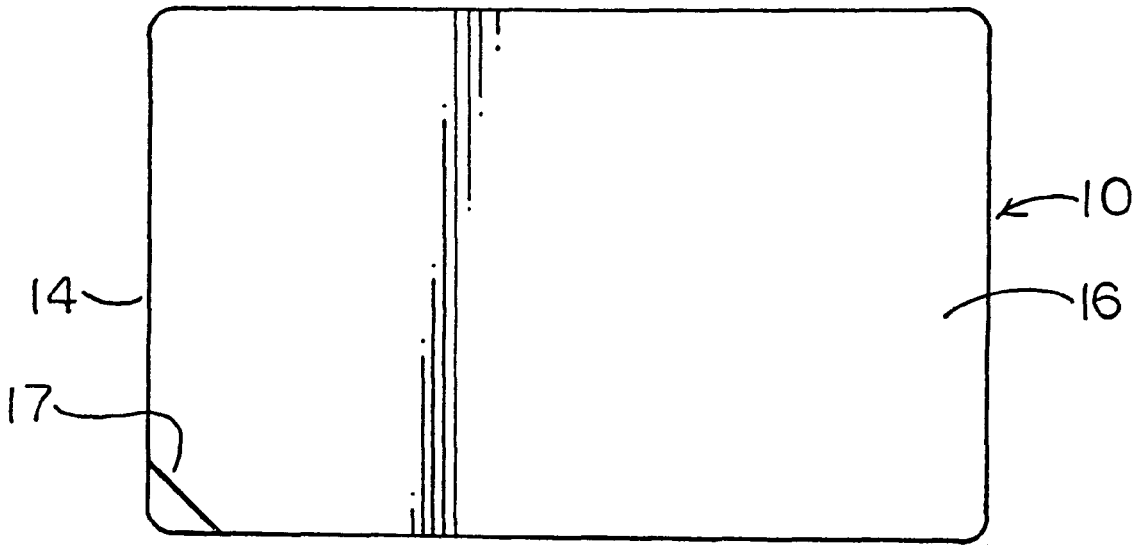
FIG. 2 is a rear elevational view of the rear side of the secondary sheet of the multiple layered cards.
Figure 3:
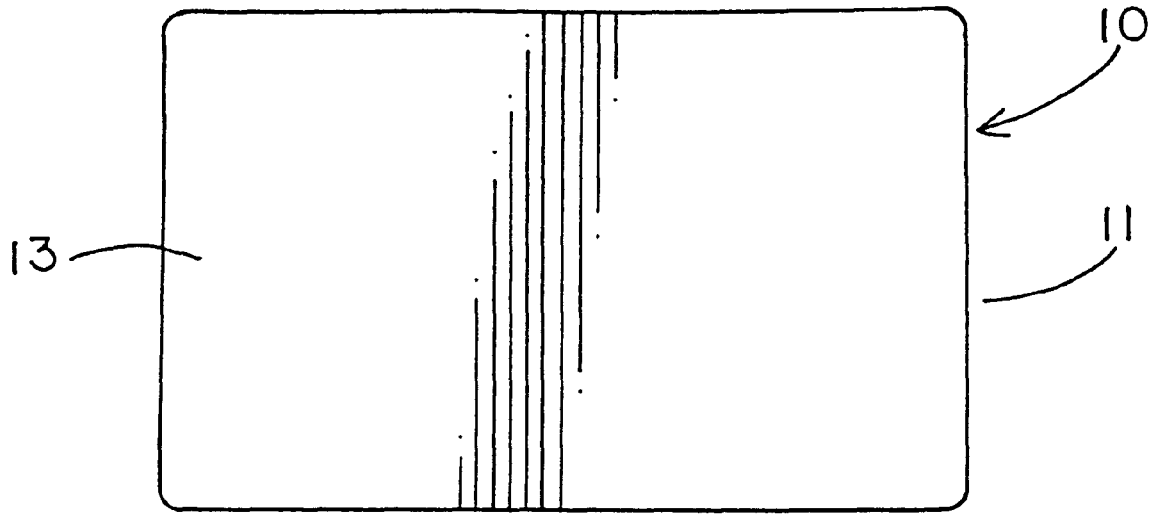
FIG. 3 is rear elevational view of the rear side of the primary sheet of the multiple layered cards.
Figure 4:
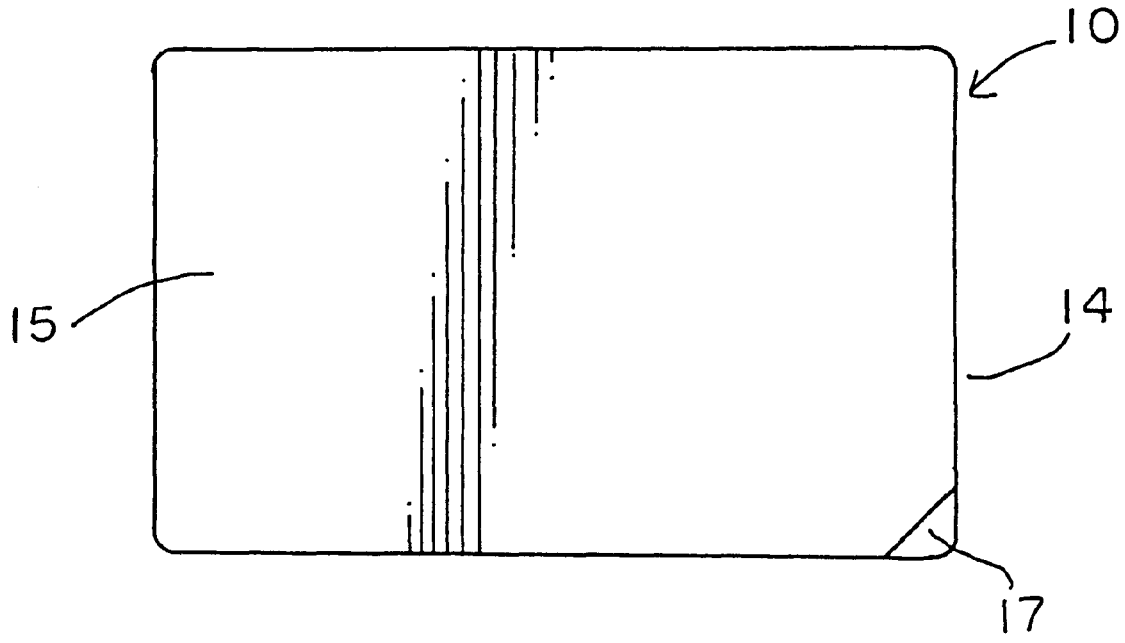
FIG. 4 is a front elevational view of the front side of secondary sheet of the multiple layered cards.
Figure 5:
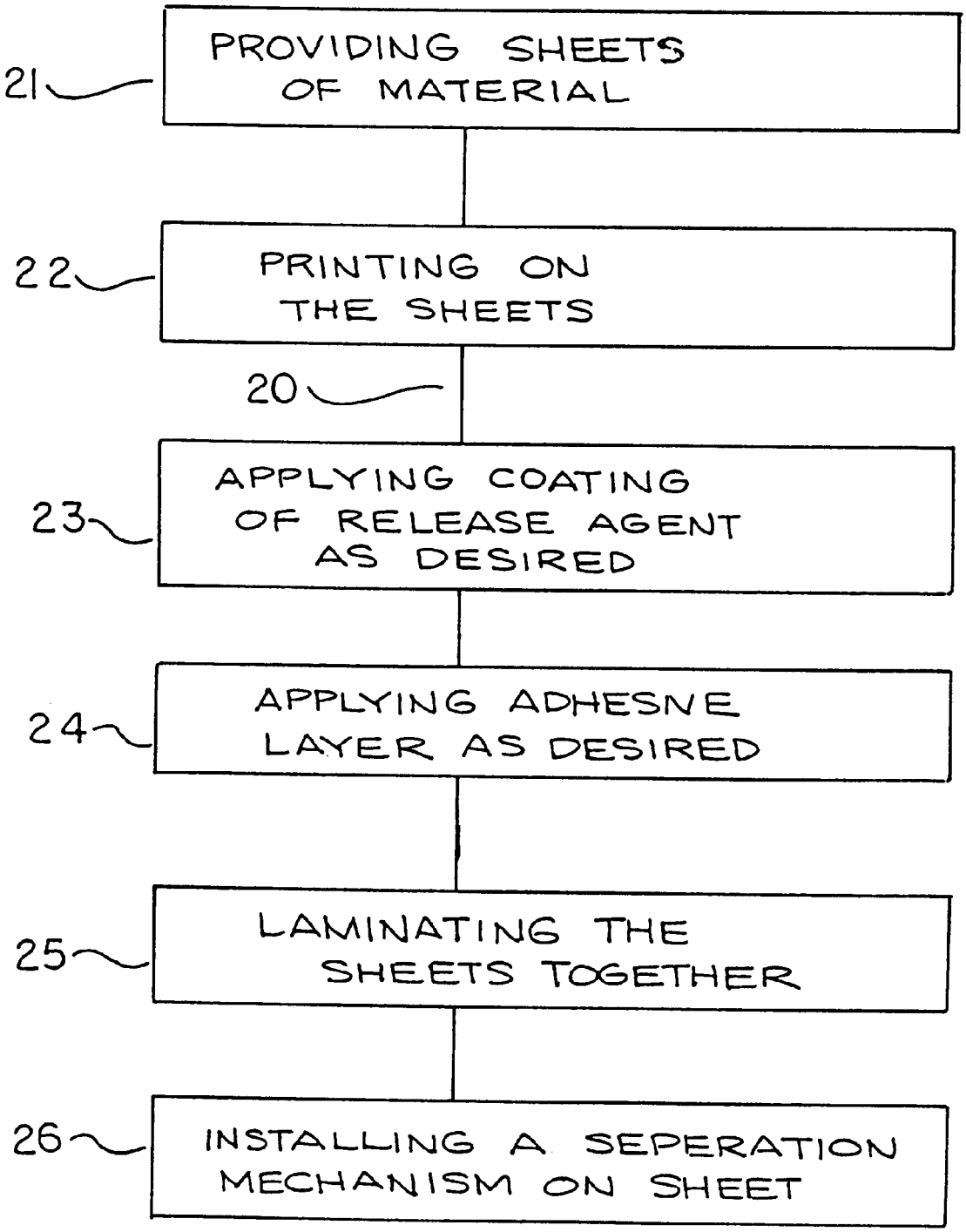
FIG. 5 is a block diagram showing the novel method of producing the multiple layered cards.

As shown in the figure, the novel multiple layered cards 10 comprises a primary sheet 11 having a front side 12 and a rear side 13. The front side 12 and the rear side 13 have a plurality of printable areas upon which instructions, contents or the like may be printed. A secondary sheet 14 is provided having a front side 15 and a rear side 16 upon which there are a plurality of printable areas that instructions, personalized information or the like can be printed thereon depending on what the specific requirements of the particular card happen to be. There may be as many sheets that comprise the card as necessary for the specific item requirement. The sheets of material can be constructed of cellulose or plastic material. It is also possible to print specific variable information to be printed on any side of the multiple sheets of the card.

The rear side 13 of the primary sheet 11 and the front side 15 of the secondary sheet 14 have a layer of adhesive applied in a predetermined pattern depending upon the specific requirements of the particular card. A release agent such as a coating of silicone or dry strippable varnish would be full or spot coated in predetermined areas of the rear side 13 of the primary sheet 11 or the front side 15 of the secondary sheet 14. The manufacturer can choose the areas of the multiple layered card to be removed by the positioning of the release coating and by the die cutting. The use of silicone or dry strippable varnish will be dependent upon the type of adhesive that is positioned over the release agent. The coating used with the release agent will be matched up with the adhesive patterns to facilitate the separation of the card 10. When the card or the release agent area on the card is separated, release agent is positioned on one sheet only and the adhesive is on the opposite sheet. In cases that do not require total separation, the release agent application would be limited to those areas where opening is desired, not the whole card.

The multiple sheets 11 and 14 are then laminated together. The lamination process presses the sheets of material together. The pattern of adhesive is layered on top of the release agent during the manufacture of the product and the lamination process transfers the adhesive onto the proper position on the other sheet. A separation mechanism 17 is positioned on one of the sheets. In the figures, this is shown as a die cut corner of the secondary sheet 14 which allows the consumer to easily grasp the corner to separate the two sheets 11 and 14. Other means can be used to accomplish a separation mechanism such as cutting one of the sheets shorter on one side than the other. A third separation mechanism can be a die cut of a particular shape made for the user's purposes for separation of an area of the card only.

The novel method 20 of producing multiple layered cards comprises the following steps: providing a sheets of material, each having a front side and a rear side 21; printing and variable imaging said sheets of material on any of the sides as desired for the purposes of the specific item 22; applying a coating of a release agent on one sheet of material to facilitate separation of the sheets of material when desired 23; applying an adhesive layer on one of said sheets of material in order to facilitate joining of the sheets together 24; laminating said sheets together 25; and installing a separation mechanism on one of said sheets to increase the ease of separation of said sheets 26.

The release agent and the adhesive can be applied in a manner that will determine those areas of the card that the manufacturer wishes to have separated by the consumer. The multiple layers of material can be produced from two separate webs of material or can be produced from a single web that is slit and crossed over onto itself during the process of manufacturing. The flexibility provided to the manufacturer afforded by this process allows an infinite number of formats of cards to be produced to meet the demands of the clients.

While I have described my invention in connection with specific embodiments thereof, it is clearly to be understood that this is done only by way of example and not as a limitation to the scope of my invention as set forth in the objects thereof and in the appended claims.

I claim:

1. Multiple layered cards, for situations that require the use of a item that can be peeled apart and reveal additional information to the user, comprising:

multiple sheets of material, at least one of said sheets of material comprising a card unit, said card unit designed to be removed in use and be independent of any substrate;

said multiple sheets of material having a primary sheet containing a front side and a rear side, said front side and said rear side having a plurality of printable areas for printing of information selected from the group of contents, instructions, personalized information;

said multiple sheets of material further having a secondary sheet containing a front side and a rear side, the front side and the rear side having a plurality of printable areas for printing of information selected from a group of contents, instructions, personalized information;

release agent means positioned in predetermined areas on one of said sheets of material;

said release means comprising the use of a spot coating of dry strippable varnish in predetermined areas on one of said sheets of material, said predetermined areas being the area beneath said card unit so that said card unit will be independent of any substrate;

attaching means positioned in predetermined areas on one of said sheets of material;

said primary sheet and said secondary sheet comprising a single entity by being laminated together transferring said attaching means to the opposite sheet;

at least one of said sheets having a separation mechanism positioned thereon; and said separation mechanism comprising a cut that must be made at least on said sheet of material comprising said card unit.

2. Multiple layered cards, according to claim 1, wherein:

said attaching means comprises the use of an adhesive in combination with said release agent positioned on said rear side of said primary sheet of said front side of said secondary sheet for holding of said multiple sheets together.

3. Multiple layered cards, according to claim 1, wherein:

said lamination of said primary and said secondary sheets of material comprises pressing said sheets of material together forming a single entity and transferring said attaching means from one sheet of material to another sheet of material.

4. Multiple layered cards, according to claim 1, wherein:

said separation mechanism comprises the use of a die cut on one of said sheets to facilitate the separation of said sheets by the user.

* * * * *